US009687706B1

(12) United States Patent
Cormier

(10) Patent No.: US 9,687,706 B1
(45) Date of Patent: Jun. 27, 2017

(54) HOCKEY STICK

(71) Applicant: Jacques Cormier, Monctun (CA)

(72) Inventor: Jacques Cormier, Monctun (CA)

( * ) Notice: Subject to any disclaimer, the term of this patent is extended or adjusted under 35 U.S.C. 154(b) by 0 days.

(21) Appl. No.: 15/076,559

(22) Filed: Mar. 21, 2016

(51) Int. Cl.
*A63B 59/14* (2006.01)
*A63B 59/70* (2015.01)
*A63B 60/12* (2015.01)
*A63B 102/24* (2015.01)

(52) U.S. Cl.
CPC ..... *A63B 59/70* (2015.10); *A63B 60/12* (2015.10); *A63B 2102/24* (2015.10)

(58) Field of Classification Search
CPC ..... A63B 2102/24; A63B 59/70
USPC ..... 473/560–563
See application file for complete search history.

(56) References Cited

U.S. PATENT DOCUMENTS

D263,329 S * 3/1982 Clayton ..... D21/727
4,544,157 A * 10/1985 Curtis ..... A63B 59/70 473/560
5,456,463 A * 10/1995 Dolan ..... A63B 59/70 473/563
6,099,421 A * 8/2000 Mayhew ..... A63B 59/70 473/560
7,282,001 B2 * 10/2007 Ponzini ..... A63B 59/70 473/560
D684,225 S * 6/2013 Lacroix ..... D21/727
2002/0066163 A1 * 6/2002 Lomax ..... A01B 1/00 16/430
2004/0147346 A1 * 7/2004 Casasanta, Jr. ..... A63B 60/06 473/568
2007/0275795 A1 * 11/2007 Barkume ..... A63B 69/0026 473/446
2010/0151975 A1 * 6/2010 Hisle et al. ..... A63B 60/06 473/568
2010/0323829 A1 * 12/2010 Cross et al. ..... A63B 59/70 473/560
2013/0045822 A1 * 2/2013 Stefan ..... A63B 59/70 473/560
2014/0100064 A1 * 4/2014 Cross ..... A63B 59/70 473/560
2015/0126310 A1 * 5/2015 Brenner ..... A63B 59/0029 473/560

* cited by examiner

*Primary Examiner* — Mark Graham
(74) *Attorney, Agent, or Firm* — Gulf Coast Intellectual Property Group

(57) ABSTRACT

A hockey stick more specifically for a goalie wherein the hockey stick includes a shaft having a upper portion, a lower portion and a blade. The upper portion and the lower portion are integrally formed and the lower portion includes a left flange and a right flange. Formed in the left flange of the lower portion proximate the upper end is a gripping member. The gripping member includes at least one notch wherein the at least one notch has a bottom and wherein the bottom is formed at an axial orientation with respect to the shaft such that an axis intersecting therethrough is diverging away from the shaft. Formed in the right flange opposite the gripping member is the receiving member. The receiving member is configured to receive the portion of a user's palm intermediate the thumb and index finger.

16 Claims, 3 Drawing Sheets

HOCKEY STICK

FIELD OF THE INVENTION

The present invention relates generally to hockey sticks, more specifically but not by way of limitation, a goalie hockey stick that includes at least one notch formed in the flange portion of the paddle wherein the notch is configured to receive the fingers of the hand of the user and further facilitate the user being able to maintain a straight wrist when holding.

BACKGROUND

Millions of individuals regularly play ice hockey either as a recreational pastime or professionally. Ice hockey is a very popular sport in North America. As is known in the art ice hockey is a team sport wherein each team fields players that play in the following positions: defensemen, right wing, left wing, center and goalie. The latter position, goalie, is considered to be the most difficult position as it is the goalie's job to end the net and inhibit the opposing team's puck from entering. The goalie will utilize specialized gear such as but not limited to blockers secured to there arms in order to successfully play the position. The goalie further utilizes a specialized stick in order to play the position.

A standard hockey stick consists of a shaft integrally formed with a blade wherein the shaft is a consistent width across its entire length. The hockey stick for the goalie is manufactured differently wherein the shaft includes an upper portion and lower portion wherein the lower portion includes integrally formed flanges on opposing sides thereof to form a greater width to assist in blocking of the puck. This lower portion is commonly referred to as the paddle. The upper portion of the shaft is consistent with a conventional hockey stick. One problem with the conventional hockey stick is the shaft does not promote the most ergonomic holding position and as such intrinsically slows the reaction time of the goalie. A conventional hockey stick requires that a goalie must maintain an angled wrist position of the hand/wrist engaged with the upper portion of the shaft. This can be uncomfortable for the goalie during long games and further lead to reduced reaction times.

Accordingly, there is a need for a hockey stick designed for a goalie wherein the upper section of the paddle is designed to ergonomically receive the fingers of the hand of the goalie at an angle that promotes a wrist angle that is substantially straight.

SUMMARY OF THE INVENTION

It is the object of the present invention to provide a hockey stick specifically for a goalie that includes a shaft having an upper portion and a lower portion with the lower portion having a paddle formed from opposing flanges.

Another object of the present invention is to provide a goalie hockey stick that promotes an improved wrist angle position for the user that further includes at least one notched formed in the upper end of the paddle.

A further object of the present invention is to provide a goalie hockey stick that is configured to promote a substantially straight wrist for a user thereof on the wrist that is at least partially engaged with the upper portion of the shaft wherein the bottom of the at least one notch has a particular axis with respect to the shaft.

Still another object of the present invention is to provide a goalie hockey stick that is operable to improve the ergonomic grip of the hockey stick and the reaction of a player utilizing the stick to block a puck wherein the alignment of the axis along the bottom of the at least one notch substantially correlates to the of the flex axis along the knuckles of a human hand in a closed position.

An additional object of the present invention is to provide a goalie hockey stick that is operable to improve the reaction time of a goalie responding to a puck wherein the at least one notch allows a user to engage the hockey stick such that the arm of the user engaging the shaft and the at least one notch is positioned such that it is at an angle of 65-70 degrees with respect to the shaft and as such promotes a wrist angle that is substantially straight.

Yet a further object of the present invention is to provide a goalie hockey stick having a paddle consisting of two opposing flanges wherein a recessed section is formed in the upper end of the flange opposite the at least one notch so as to accommodate a user's thumb.

Another object of the present invention is to provide a goalie hockey stick wherein the upper end of the paddle is formed with a chamfer having an angle of approximately 60 to 65 degrees from the lower edge of the at least one notch.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
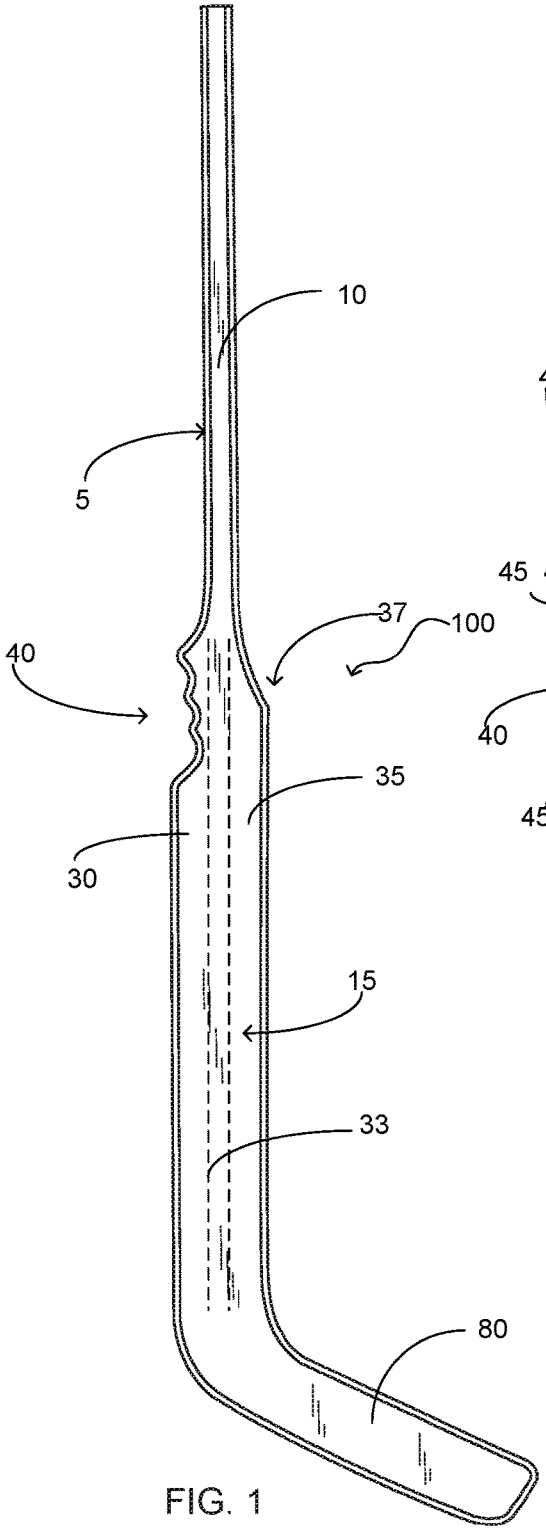
FIG. 1 is a front view of a preferred embodiment of the present invention.

Referring now to the drawings submitted herewith, wherein various elements depicted therein are not necessarily drawn to scale and wherein through the views and figures like elements are referenced with identical reference numerals, there is illustrated a hockey stick 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
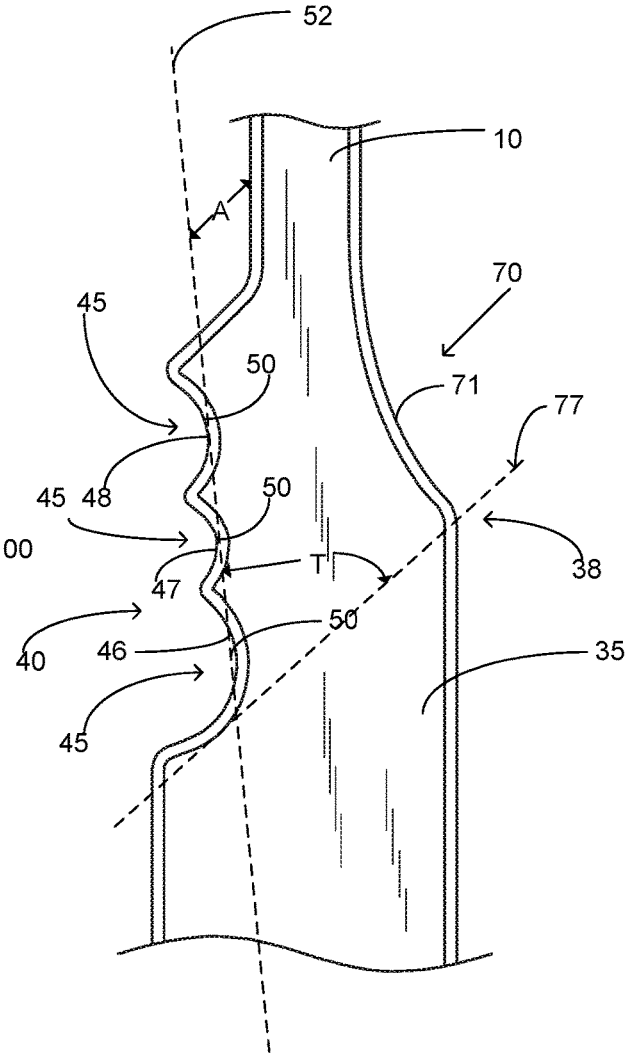
FIG. 2 is a detailed view of the upper end of the paddle of the present invention.

Referring in particular to FIGS. 1 and 2 herein, the hockey stick 100 includes shaft 5 having an upper portion 10 and a lower portion 15. The shaft 5 is integrally formed with the blade 80. The hockey stick 100 is manufactured from a suitable durable material such as but not limited to wood or carbon fiber. The upper portion 10 is configured to have a width that is less than that of the lower portion 15. The lower portion 15 includes a left flange 30 and right flange 35 integrally formed with the central portion 33, which is an integral extension of the upper portion 10. It is contemplated within the scope of the present invention that the shaft 5 could be manufactured in numerous different lengths.

Formed in the upper end 37 of the lower portion 15 is the gripping member 40. The gripping member 40 is configured to facilitate a user engaging the hockey stick 100 such that the gripping member 40 promotes a grip wherein the wrist of the hand engaging the gripping member 40 is substantially straight. The gripping member 40 includes a plurality of notches 45 that are formed so as to receive four fingers of a user's hand. In the preferred embodiment illustrated herein in FIG. 2, the gripping member 40, formed in the left flange 30, includes a first notch 46, second notch 47 and third notch 48 formed adjacent to each other. In the preferred embodiment illustrated in FIG. 2, the first notch 46 is configured to receive the index finger of the hand of the user, the second notch 47 is configured to receive the middle finger of the hand of the user and the third notch 48 is formed having a width sufficient in size to accommodate the third and fourth finger of the hand of the user. While three notches 45 have been described and illustrated herein as being preferred, it is contemplated within the scope of the present invention that the gripping member 40 could have as few as one notch sized to accommodate one or all of the four fingers of a human hand or include up to four notches 45 in order to individually accommodate all four fingers of a user's hand. It is further desired within the scope of the present invention that the gripping member 40 formed in the left flange 30 does not comprise central portion 33 so as to preserve the structural integrity of the hockey stick 100. The notches 45, in particular the notch 45 operable to receive an index finger of a human hand further provides an improved grip such that more of the index finger engages the rear side of the lower portion 15. As is known in the art, the strength of a human hand grip is improved with a leveraged index finger and as such the construction of the notch 45 as described herein improves a players ability to grip the hockey stick 100 so as to substantially inhibit kickback rotation of the hockey stick 100 when impacted by a fast moving hockey puck.

Figure 3:
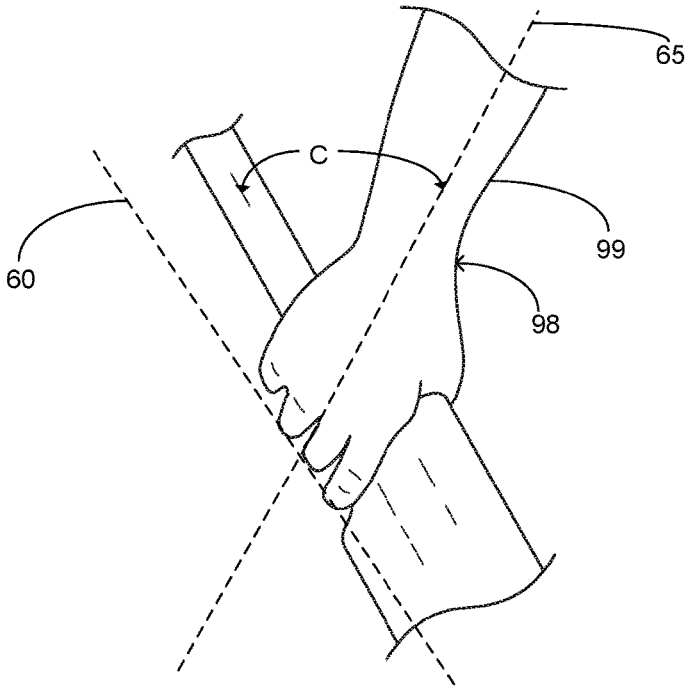
FIG. 3 is a detailed view of an exemplary hand of a user engaging the upper end of the paddle of the present invention.

The bottom 50 of the notches 45 are formed along axis 52. The axial alignment of the bottom 50 of the notches 45 are operable to create angle A between axis 52 and the upper portion 10. Axis 52, illustrated in FIG. 2 herein, corresponds to axis 60, illustrated in FIG. 3 herein, which is the knuckle-flexing axis of the knuckles of a human hand relative to the central longitudinal axis 65. The central longitudinal axis 65 is that of the center of the user's arm 99. Axis 52 is diverging away from upper portion 10 wherein the angle A therebetween is approximately 10 to 12 degrees. As the gripping member 40 is formed so as to promote the correspondence of axis 52 and axis 60, the user's hand is positioned such that the wrist 98 is substantially straight having an angle C between the central longitudinal axis 65 and upper portion 10 of approximately 65 to 70 degrees. The gripping member 40, in particular the formation of the bottom 50 of the notches 45 along axis 52 provides an improved engagement of the hockey stick 100 for pulling and pushing thereof as the gripping member 40 promotes a substantially straight central longitudinal axis 65. A user with a substantially straight central longitudinal axis 65 has improved responsiveness and a reduced reaction time during playing a game of ice hockey. The neutral wrist position as provided by the substantially straight central longitudinal axis 65 further provides improved grip performance. As is known in the art, the percentage grip contribution to the strength of an overall grip for the index, middle, ring and small fingers are approximately 25%, 35%, 25% and 15% respectively. The plurality of notches 45 combined with the receiving member 70 provides an improved technique of capitalizing on the source of strength of a human grip.

Figure 5:
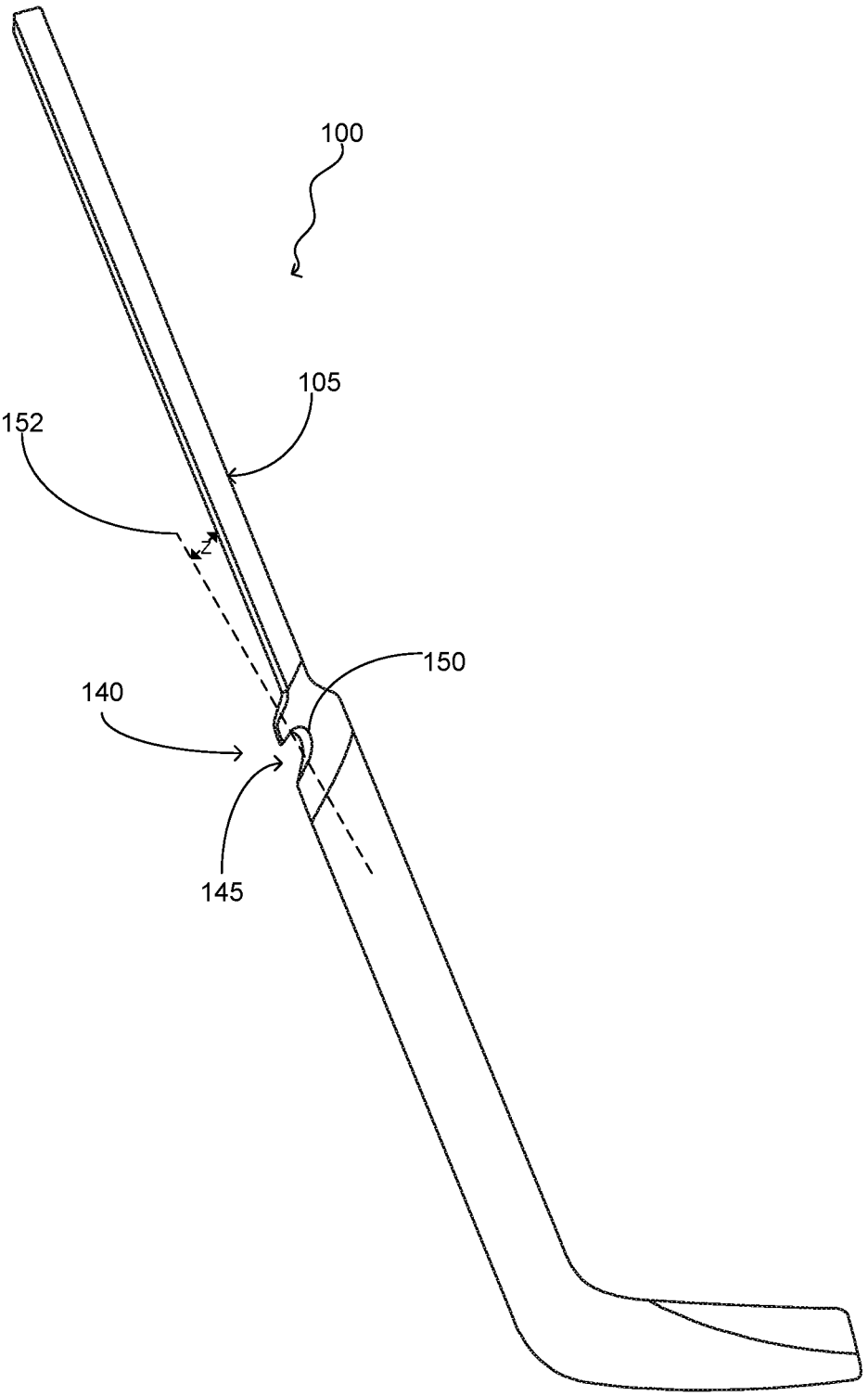
FIG. 5 is a front view of an alternative embodiment of the present invention.

An alternative embodiment of the gripping member 140 is illustrated herein in FIG. 5. It is contemplated within the scope of the present invention that the bottom 150 of the notch 145 illustrated is formed with respect to the shaft 105 such that the axis 152 is diverging away from the shaft 5 at an angle Z of approximately 10 to 12 degrees, similarly to angle A. A previously described herein. The alternative embodiment of the gripping member 140 illustrated herein in FIG. 5 illustrates a gripping member 140 that includes only one notch 145 wherein the notch 145 is sized to accommodate the four fingers of the hand of the user. As previously stated herein, it is contemplated that the notch 145 could be sized to accommodate all four fingers of a user's hand or less than four fingers. All other construction of the hockey stick 100 illustrated herein in FIG. 5 is the same.

Receiving member 70 is formed at the upper end 38 of right flange 35. The receiving member 70 is configured with an edge 71 having a radius configured to receive the area of a user's hand intermediate the thumb and index finger thereof. It is preferred within the scope of the present invention that the receiving member 70 is formed with a chamfer such that the angle T between axis 77 and axis 52 is approximately 60 to 65 degrees.

Figure 4:
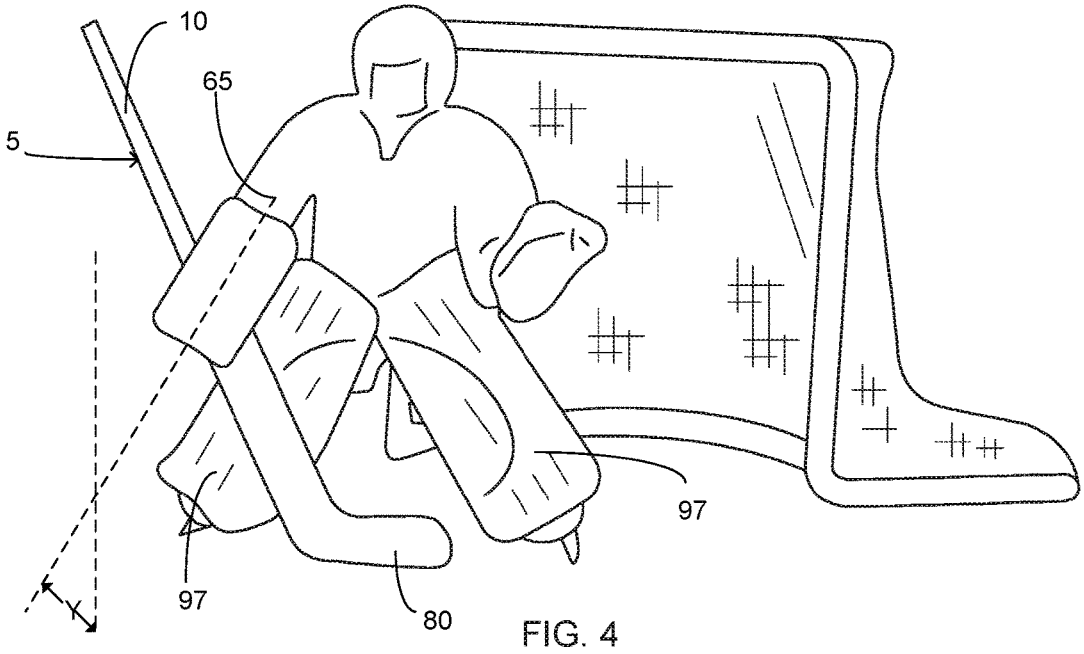
FIG. 4 is a perspective view of the present invention in use.

The blade 80 of the hockey stick 100 is integrally formed with the lower portion 15. While no particular size of the blade 80 is required, good results have been achieved with blade 80 being fifteen and a half inches in length and three and a half inches in height. Those skilled in the art should recognize that the blade 80 could be manufactured in various sizes. As shown in particular in FIG. 4 herein, the gripping member 40 promotes a holding position of the hockey stick 100 wherein the blade 80 is intermediate a user's legs 97 and the angle Y intermediate the central longitudinal axis 65 and an exemplary vertical line 2 is approximately 40 to 45 degrees. While the gripping member 40 and receiving member 70 have been illustrated and discussed herein as being formed in the left flange 30 and right flange 35 respectfully, it is contemplated within the scope of the present invention that the gripping member 40 and receiving member 70 could be formed in the opposing flange in so as to provide a hockey stick 100 formed to accommodate a right-handed or left-handed player.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A hockey stick comprising:

a shaft, said shaft having an upper portion and a lower portion, said upper portion having a width that is less than that of said lower portion, said lower portion further having a left flange and a right flange integrally formed with a central portion, said central portion being an extension of said upper portion, said lower portion having an upper end and a lower end;

a blade, said blade being integrally formed with said lower portion proximate said lower end;

a gripping member, said gripping member being formed in either said left flange or said right flange of said lower portion, said gripping member being proximate said upper end of said lower portion, said gripping member having a first notch and a second notch, said first notch and said second notch being adjacently formed, said first notch being distal to said upper portion, said first notch formed at a depth towards said central portion that is greater than said second notch, said first notch and said second notch having a bottom, said bottom of said first notch and said second notch formed at an angle with respect to said shaft such that an axis extending through said bottom of said first notch and said second notch diverges away from said shaft; and wherein said first notch and said second notch are configured to receive four fingers of a users hand engaged therewith and position the four fingers at an angle such that a wrist of the user is substantially straight.

2. The hockey stick as recited in claim 1, and further including a receiving member, said receiving member formed in said lower portion opposite said gripping member, said receiving member configured to engage an area of a user's hand intermediate an index finger and thumb.

3. The hockey stick as recited in claim 2, wherein an axis extending through the bottom of said first notch and said second notch has an angle with respect to the shaft of approximately 10 to 12 degrees.

4. The hockey stick as recited in claim 3, wherein the angular orientation of the bottom of said first notch and said second notch promotes an angle between a central longitudinal axis extending through a user's arm engaged with the hockey stick and the shaft wherein the angle is approximately 65 to 70 degrees.

5. The hockey stick as recited in claim 4, wherein said receiving member is manufactured having a chamfer of approximately 60 to 65 degrees.

6. A hockey stick for a goalie that is configured to provide an improved ergonomic engagement therewith comprising:

a shaft, said shaft having an upper portion and a lower portion, said upper portion having a width that is less than that of said lower portion, said lower portion further having a left flange and a right flange integrally formed with a central portion, said central portion being an extension of said upper portion of said shaft, said lower portion having an upper end and a lower end;

a blade, said blade being integrally formed with said lower portion proximate said lower end;

a gripping member, said gripping member being formed in said left flange of said lower portion, said gripping member being proximate said upper end of said lower portion, said gripping member having a plurality of notches, said plurality of notches extending inward towards said central portion and having a bottom, said bottom of said plurality of notches formed at an angle with respect to said shaft such that an axis extending through said bottom of said plurality of notches diverges away from said shaft, said plurality of notches being contiguously formed and adjacent, wherein one of said plurality of notches distal to said upper portion extends inward towards said central portion a distance that is greater; and wherein said plurality of notches are configured to receive four fingers of a users hand engaged therewith and position the four fingers at an angle such that a wrist of the user is substantially straight.

7. The hockey stick as recited in claim 6, and further including a receiving member, said receiving member formed in said right flange opposite said gripping member, said receiving member configured to engage an area of a user's hand intermediate an index finger and thumb.

8. The hockey stick as recited in claim 7, wherein the angular orientation of the bottom of said plurality of notches promotes an angle between a central longitudinal axis extending through a user's arm engaged with the hockey stick and the shaft wherein the angle is approximately 65 to 70 degrees.

9. The hockey stick as recited in claim 8, wherein said receiving member is manufactured having a chamfer of approximately 60 to 65 degrees.

10. The hockey stick as recited in claim 9, wherein the axis extending through the bottom of said plurality of notches has an angle diverging away from said shaft at approximately 10 to 12 degrees.

11. A hockey stick configured to be utilized by a goalie in a game of ice hockey wherein the hockey stick provides an improved and stronger grasp thereof operable to facilitate a faster response to an oncoming puck comprising:

a shaft, said shaft having an upper portion and a lower portion, said upper portion having a width that is less than that of said lower portion, said lower portion further having a left flange and a right flange integrally formed with a central portion, said central portion being an extension of said upper portion of said shaft, said lower portion having an upper end and a lower end;

a blade, said blade being integrally formed with said lower portion proximate said lower end;

a gripping member, said gripping member being formed in said left flange of said lower portion, said gripping member being proximate said upper end of said lower portion, said gripping member having a first notch, a second notch and a third notch, said first notch being distal to said upper portion of said shaft, said first notch, second notch and said third notch extending inwards towards said central portion, said first notch extending inward towards said central portion at a distance greater than said second notch and said third notch, said first notch, second notch and third notch having a bottom, said bottom of said first notch, second notch and third notch formed at an angle with respect to said shaft such that an axis extending through said bottom of said first notch, second notch and third notch diverges away from said shaft at an angle of approximately 10 to 12 degrees; and wherein said first notch, second notch and third notch are configured to receive four fingers of a users hand engaged therewith and position the four fingers at an angle such that a wrist of the user is substantially straight.

12. The hockey stick as recited in claim 11, wherein said third notch is configured to receive a small finger and an adjacent finger of a user's hand.

13. The hockey stick as recited in claim 12, and further including a receiving member, said receiving member formed in said right flange opposite said gripping member, said receiving member configured to engage an area of a user's hand intermediate an index finger and thumb.

14. The hockey stick as recited in claim 13, wherein the angular orientation of the bottom of said first notch, said second notch and said third notch promotes an angle between a central longitudinal axis extending through a user's arm engaged with the hockey stick and the shaft wherein the angle is approximately 65 to 70 degrees.

15. The hockey stick as recited in claim 14, wherein said receiving member is manufactured having a chamfer of approximately 60 to 65 degrees.

16. The hockey stick as recited in claim 15, wherein the first notch of said gripping member being formed to receive an index finger of a human hand and wherein the first notch functions to provide an improved grip of the hockey stick by a player so as to substantially inhibit kickback rotation caused by the impact from a rapidly moving hockey puck.

* * * * *